United States Patent [19]

Hamm

[11] Patent Number: 4,712,042

[45] Date of Patent: Dec. 8, 1987

[54] VARIABLE FREQUENCY RFQ LINEAR ACCELERATOR

[75] Inventor: Robert W. Hamm, Pleasanton, Calif.

[73] Assignee: AccSys Technology, Inc., Pleasanton, Calif.

[21] Appl. No.: 825,273

[22] Filed: Feb. 3, 1986

[51] Int. Cl.[4] ..... H05H 9/02; H05H 7/12

[52] U.S. Cl. ..... 315/5.41; 315/5.42; 315/5.43; 315/5.39; 315/5; 315/5.46; 315/5.47; 313/359.1; 328/233

[58] Field of Search ..... 328/208, 215, 234, 235, 328/256, 259; 313/62, 157, 158, 159, 307, 309, 360.1; 315/5.41, 5.42, 5.43, 5.46, 5.47; 333/219, 233; 334/20, 56, 60, 63, 68, 69, 71, 72, 75

[56] References Cited

U.S. PATENT DOCUMENTS 2,511,580 6/1950 Goodrich, Jr. ..... 334/20
4,459,571 7/1984 Fraser ..... 333/219

FOREIGN PATENT DOCUMENTS 0550329 12/1957 Canada ..... 333/82
0163745 12/1985 European Pat. Off. .

OTHER PUBLICATIONS

Schempp, A.; "Frequenztuning von λ/2 RFQ Resonatoren"; Int. Rep. 82-5; Instit. fur Angewandte Physik der Univ. Frankfurt/Main; Apr. 1982.

Glavish, H. F.; "Radio-Frequency Linear Accelerator for Commercial Ion Implanters"; *Nucl. Instr. and Mthds. in Physics Res.;* vol. B24/25 (1987), pp. 771-775.

Huson et al., "Multi-MeV Ion Implantation Accelerator System," *9th Conf. on the Appl. of Accelerators in Res. and Ind.,* Nov. 1986.

Angert, et al., "Heavy Ion Radio Frequency Quadrupole (RFQ) Accelerators: A New Tool for Ion Implantation," *Vacuum,* vol. 36, No. 11-12, Nov./Dec. 1986, pp. 969-972.

Klein, "Development of the Different RFQ Accelerating Structures and Operation Experience," 8/1983, vol. NS-30, No. 4, IEEE Trans. Nuc. Sci., pp. 3313-3321.

*Primary Examiner*—Leo H. Boudreau
*Assistant Examiner*—Michael J. Nickerson
*Attorney, Agent, or Firm*—Francis H. Lewis

[57] ABSTRACT

A variable frequency RFQ linear accelerator has a sequence of variable inductance coils connected at intervals along the electrode vanes, such that each coil together with the corresponding section of the vanes forms an LC resonant circuit having a resonant frequency equal to the operating frequency of the accelerator. The variable inductance coils are each comprised of a helical bifilar coil, with each filament of a given coil being connected to one pair of vane electrodes on opposite sides of the beam axis, and a movable shorting bar is provided for each bifilar coil to vary the inductance. The helical bifilar coils in adjacent sections are disposed on opposite sides of the beam axis, the axes of the coils on either side being parallel to the beam axis and mutually coincident. Drive shafts extend along these axes through the wall of the vacuum vessel, with control rods extending radially outward to each of the shorting bars, and a ganging mechanism is provided to control all of the shorting bars so that the LC circuits all maintain the same resonant frequency. The power supply is connected to the vane electrodes through a capacitive impedance. Mode switches are further provided at the ends of the bifilar inductance coils to avoid interfering resonances from the sections of the coils beyond the shorting bars.

54 Claims, 10 Drawing Figures

VARIABLE FREQUENCY RFQ LINEAR ACCELERATOR

BACKGROUND OF THE INVENTION

This invention pertains generally to the field of accelerators for atomic and nuclear particles, and more particularly, to linear accelerators which utilize radio-frequency quadrupole (RFQ) electric fields for accelerating, focusing, and bunching a beam of ions.

For many years it has been well-known that conventional linear accelerators (linacs) employing drift tubes and the like, with magnetic accelerating and focusing fields, are generally inadequate for transporting and accelerating ion beams at low energies. The main drawback of these conventional linacs is that the particle velocities in such ion beams is so low that the Lorentz forces on the particles are too small to control the beam for any magnetic fields that can be achieved practically. In order to accelerate ions in conventional linear accelerators, one must employ an injection system between the ion source and the accelerator to raise the energy of the beam particles and to focus and bunch these particles to obtain a beam that is suitable for acceleration. For several decades the design of this injection system, i.e. an accelerator for low-energy ion beams, presented a challenge to researchers in this field.

In 1970 I. M. Kapchinskii and V. A. Teplyakov suggested the RFQ linear accelerator as a possible solution to this problem ("Linear Ion Accelerator with Spatially Homogeneous Strong Focusing", Prib. Tekh. Eksp. 2, 19 (1970)). This device contains no drift tubes, but rather comprises four elongated electrodes disposed symmetrically around the beam, each electrode extending in a direction parallel to the beam axis. The electrodes are driven by radio-frequency (rf) electrical power, such that the voltage on each electrode is approximately constant along its entire length at any given time. Furthermore the voltages of each pair of electrodes on opposite sides of the beam axis are the same, and are equal in magnitude and opposite in sign to the voltages on the other pair of oppositely-disposed electrodes, so that all points in the beam the electric fields in the plane perpendicular to the beam axis are primarily quadrupolar. The particle beam is thereby exposed to an alternating-gradient quadrupole electric field which produces the well-known strong-focusing effect, and this effect is independent of the velocity of the beam particles.

Of course, if the electrodes are at a constant distance from the beam axis along their entire length, then the electric fields are completely transverse to this axis. The above authors pointed out, however, that if the distance of each pair of diametrically opposed electrodes from the beam axis varies with spatial periodicity along this axis, and if the distance of the adjacent pair of oppositely-charged electrodes also varies with the same period, but with a phase difference along the axis of 180° relative to the first electrode pair, then an electric field component parallel to the beam axis will be produced. Thus, for each of the electrodes the surface facing toward the beam axis is rippled so that the distance of this surface from the axis oscillates between a minimum value, a, and a maximum value, ma ($m<1$), as one proceeds in the direction parallel to the beam axis (conventionally defined as the z-direction). The distance, d, between adjacent ripples on a given electrode, and the minimum and maximum distances from the electrode to the beam axis (a and ma) are the same for all four electrodes. For a given pair of electrodes lying in a plane passing through the beam axis, the crests of the ripples occur at the same positions along the beam axis, and these positions also mark the location of the ripple troughs in the other pair of electrodes lying in the orthogonal plane through the beam axis. The electric field extending from the ripple crests of one pair of electrodes to the crests of the adjacent electrodes lying in the orthogonal plane therefore has an axial component.

The ripple crests define the boundaries of a series of unit cells arranged along the beam axis, each cell having a width d/2 in the z-direction. At all points within any given unit cell the z-component of the electric field is in the same direction along the beam axis, and in the adjacent unit cells on either side of the given cell the z-component is in the opposite direction. Therefore the electric fields in successive unit cells have an alternately accelerating and decelerating effect on the beam particles, and these fields also tend to cause the beam to bunch in alternate cells. For a given beam particle velocity, v, the frequency, f, of the electrode voltage oscillations is such that the period of these oscillations equals the transit time of the particles through the distance d, $$f=v/d,$$

so that the particle bunches will continue to encounter an accelerating electric field as they move in the z-direction from one unit cell to the next cell.

Therefore, the RFQ linear accelerator structure suggested by Kapchinskii and Teplyakov is capable of focusing, bunching and accelerating a beam of charged particles even for low particle velocities. Of course, as the particles are accelerated in traveling down the length of this structure their velocities will increase. This implies that the distance, d, between ripples on a given electrode surface must be made larger in the downstream portions of the accelerator. The magnitude of the acceleration will be affected by the dimensions of the ripples, a and ma, and by the magnitudes of the electrode voltages; these voltages, however, characterize the whole structure and only determine an overall scale factor for the amount of energy transferred to the beam particles. For example, if the ripple dimensions, a and ma, are constant down the entire length of the electrodes, and if we assume that the axial accelerating fields are constant in time as seen by the beam particles, the acceleration of these beam particles will be constant and the speed of the particles will be proportional to the square root of the distance traveled. (We are assuming also that the beam particle velocities are sufficiently low that the effects of special relativity may be ignored.) This implies that the distance d and the widths of the unit cells must also increase in direct proportion to the square root of the axial distance down the accelerator. Obviously this particular dependence of the quantity d on axial position is sensitive to the assumption of constant particle acceleration, and if the heights of the ripples vary with axial position, then the widths of the unit cells should be varied accordingly so that the transit time through a unit cell remains constant, regardless of the beam particle mass or charge, or the electrode voltage.

Various researchers at different laboratories have carried through the detailed design of the electrode geometry and analysis of the particle beam dynamics for a variety of RFQ linacs designed for a number of different practical applications. The typical RFQ linac employs vane-like or rod-like electrodes having values for the ripple sizes a, and ma, that increase gradually with axial distance downstream. At the injection end of the accelerator the axial fields are zero, and the first few unit cells, called the "radial matcher", are designed to optimize the matching of the dc ion beam in the time-varying fields of the accelerator. This section is followed by the "shaper" section, then the "gentle buncher" which produces more efficient adiabatic bunching and higher beam intensities, and finally the accelerator section. Various profiles for the electrode surfaces in the plane transverse to the beam axis have been studied, including the hyperbolic and wedge shapes originally suggested by Kapchinskii and Teplyakov. The design techniques and operating experiences for different types of RFQ linacs have been carefully reviewed in an article by H. Klein ("Development of the Different RFQ Accelerating Structures and Operating Experience", *IEEE Transactions on Nuclear Science,* Vol. NS-30, No. 4, August, 1983), and a summary of the various RFQ linacs in operation, under construction, or in the preliminary design phases has been given by S. O. Schriber ("Present Status of RFQ's", 1985 Particle Accelerator Conference, Vancouver, Canada; May 13–17, 1985; IEEE Transactions on Nuclear Science, Vol. NS-32, No. 5, Page 3134 (1985)).

As pointed out by Klein in the above review article, the RFQ designs to date suffer from the disadvantage that the design parameters are strongly dependent on each other, and any given layout tends toward inflexibility. One usually starts by choosing the ion species to be accelerated, having a certain charge-to-mass ratio, and then proceeds to select an operating frequency. These frequencies may vary by a factor of 10 or more, depending upon the desired application and ion species. Once the operating frequency is chosen, a resonating RFQ structure must be designed that will cause the electrode voltages to oscillate at the chosen frequency. These resonators fall generally into two distinct categories: resonant cavities and resonating LC-structures. Resonant cavities are used at frequencies above 150 MHz, because below this limit the dimensions of the cavities become impractically large. The LC-structures are analogous to dual-conductor transmission lines, and are useful at frequencies below 150 MHz. A hybrid type of structure, known as the split coaxial resonator (SCR), has some of the characteristics of both types of rf-structure, but in practical terms it can only be designed for frequencies between a few Mhz up to about 100 Mhz. This SCR structure is described in U.S. Pat. No. 4,404,495 (Mueller), which discloses an embodiment of this device designed to operate at 13.5 MHz to accelerate very heavy ions having an atomic mass/charge ratio in excess of 100, with beam currents in the milliampere range.

In most of the previous designs for RFQ linear accelerators, then, it is found that once an operating frequency and resonating rf-structure have been chosen, the design is fairly "locked in" to that frequency, and to accelerate beams with a different frequency one must make substantial alterations to the resonating structure. This, in turn, limits the beam characteristics that one can obtain with any given RFQ accelerator. For a particular species of ion with a given charge-to-mass ratio, the input and output energies of the beam are limited to the values that correspond to the fixed operating frequency. Of course, each resonating structure generally requires a certain amount of "tuning", i.e. variation of the physical parameters to adjust the resonant frequency to its desired value. Various techniques have been developed for tuning rf resonators, such as the insertion of a vacuum capacitor or "tuning ball" as disclosed in U.S. Pat. No. 4,494,040 (Moretti). In the case of commonly used designs of RFQ resonators, as pointed out by Klein in the article cited above, tuning of the resonators is generally difficult, partly because of the strong interdependence of the RFQ design parameters. In the context of Klein's remarks, of course, "tuning" refers to variations in the operating frequency over a relatively small range.

In short, the advantages of being able to operate a linear ion accelerator over a wide range of frequencies are that, for any given ion species, one can obtain an accelerated beam of various different energies, and conversely, for a given beam energy one can accelerate ions with various different charge-to-mass ratios. The ability to control these parameters over a large range makes available a variety of important applications and interesting experiments for these accelerators, spanning the fields of atomic and solid state physics, nuclear chemistry, and radiation biology, in addition to their usefulness as injectors for larger machines. These advantages have been recognized by researchers in the field of linear accelerator development. For example, M. Odera has described the design and operating characteristics of a frequency tunable linac in Japan ("Report on Frequency Tunable Linac", Proceedings of the 1984 Linear Accelerator Conference, Seeheim, West Germany; GSI-84-11 Conf., p. 36 (September, 1984)). This is a drift-tube accelerator in which the frequency is varied by a quarter-wave coaxial resonator stub with a "race-track" cross section and a movable shorting device, connected and coupled to the drift-tubes. By moving the shorting device over a distance of approximately 2 meters, the operating frequency of the accelerator can be varied between 17 MHz and 60 MHz, although in practice the maximum operating frequency is 45 MHz, based on other practical considerations. With this accelerator ions from Hydrogen to Gold have been accelerated from energies of 0.6 MeV/amu to 4 MeV/amu.

To accelerate the heaviest ions in the periodic table, it is generally desirable to operate at frequencies down to the few-MHz range. With the Japanese machine described above, already at 17 MHz the tuning structure must be over 6 feet long, and of course this machine does not have the additional advantages of the RFQ design. However, the article by Odera illustrates how much flexibility can be obtained with a machine in which the operating frequency can be varied by a factor of three.

A variable freuency RFQ linear accelerator in Frankfurt, West Germany, has been described by A. Schempp and co-workers ("Status of the Frankfurt Zero-Mode Proton RFQ", 1983 Particle Accelerator Conference, Santa Fe, New Mexico; August, 1983; *IEEE Transactions on Nuclear Science,* Vol. NS-30, No. 4, Page 3536 (1983)). The RFQ structure of this machine includes electrodes that are supported by pairs of radial stems at periodic intervals along the electrodes, each stem comprising a flat strip-like conducting support having a U-shaped end, with the flat surfaces of these stems perpendicular to the beam axis. The beam axis passes between the legs of the "U", each of which is attached to one of the equivalent electrodes on opposite sides of the beam axis. The stem extends from the electrode pair to a common conducting support surface, which forms an electrical ground. The adjacent stem in each pair is similarly connected to the opposite pair of electrodes at a slightly displaced axial position, and the two stems extend downward from the electrodes to the electrical ground surface at an angle relative to each other. Each pair of stems together with the conducting ground surface form a lumped inductance element which may be approximated by a single triangle-shaped loop, where the two stems and the electrically grounded support surface corespond to the sides of the triangle. The resonating structure therefore comprises the electrodes loaded periodically with these inductive support stems.

The incorporation of the electrode supports into the resonant rf-structure as periodic inductive loads is a well-known concept. For example, the "spiral stem RFQ resonator" is a system in which the electrode supports are each a spiral coil around the beam axis, with one end connected to a pair of electrodes and the other end connected to the ground surface. This structure is described by both Klein and Schempp, as well as other authors (e.g. R. H. Stokes at al., "A Spiral-Resonator Radio-Frequency Quadrupole Accelerator Structure", *IEEE Transactions on Nuclear Science,* Vol. NS-30, No. 4, p. 3530 (August, 1983)). However, the unique feature of the straight support stems in the Frankfurt machine is that the inductance may be varied by connecting a "shorting bar" to each pair of stems at various positions along the length of the support strips. Each stem has a slotted hole extending lengthwise, and the shorting bar is a flat conducting strip-like member having a similarly slotted hole. The bar can be attached to each stem by bolts which pass through the slots in each stem and the bar, and the slots allow this point of attachment to be adjusted, thereby varying the size of the triangular loop and the resulting inductance. This structure is illustrated in FIG. 3 of the article by Schempp et al. cited above, and it has been claimed that this structure allows one to vary the resonance frequency by a factor of 3 (A. Schempp et al., "Zero-Mode-RFQ Development in Frankfurt", Proceedings of the 1984 Linear Accelerator Conference, Seeheim, West Germany; GSI-84-11 Conf., p. 100 (September, 1984)).

There are some obvious drawbacks to this scheme for achieving variable resonance frequencies. Clearly the machine is not intended to allow the frequency to be varied during normal operation. Adjusting the frequency requires entering the vacuum vessel in which the entire assembly is located, and adjusting each shorting bar individually. In fact, the structure for varying the frequency in the Frankfurt machine is really intended as a tuning system, and the authors mention that this is done by removing the RFQ structure from the tank and aligning and tuning it ona bench outside the tank (A. Schempp et al., *Nuclear Instruments and Methods in Physics Research,* Vol. B10/11, p. 831 (1985)).

Furthermore, it has been observed that in the rf-structure of the Frankfurt machine, there apparently is non-negligible mutual inductance between different pairs of support stems (R. M. Hutcheon, "A Modeling Study of the Four-Rod RFQ", Proceedings of the 1984 Linear Accelerator Conference, Seeheim, West Germany; GSI-84-11 Conf., p. 94 (September, 1984). The operating frequency and design of the machine is necessarily affected by this magnetic cross-coupling of the support stems. This means, for example, that the design of the resonance structure is affected by the length of the machine, because as the length of the electrodes is increased and more support stems are added, the resonance frequency will change. This has been regarded as a "significant limitation" for RFQ linacs in general, in that it places an upper limit on the feasible length of the machine, and therefore a lower limit on the charge-to-mass ratio of the ions that can be accelerated (L. M. Bollinger, "Present Status and Probable Future Capabilities of Heavy-Ion Linear Accelerators", Proceedings of the 10th International Conference on Cyclotrons and Their Applications, Michigan State University, p. 504 (May, 1984)).

Finally, it will be noted that the variable frequency Frankfurt machine is designed to operate as a proton accelerator at 108 MHz, and Schempp and his co-authors indicate that the only resonators that will enable an RFQ linac to operate in the 10–20 MHz range are the split coaxial resonator and the spiral stem resonator, neither of which is designed for variable frequencies. Clearly these authors did not consider their variable-frequency RFQ design to be feasible in the few-MHz frequency range.

SUMMARY OF THE INVENTION

The present invention is an RFQ linear accelerator which can be operated over a continuously variable range of frequencies from a few MHz up to at least 100 MHz, and which is designed to produce beams of charged particles of up to several MeV energy at milliampere intensities for a wide range of particle charge-to-mass ratios. Four vane-shaped elongated electrodes are spaced symmetrically around the axis of the particle beam, oriented parallel to this beam axis, and located inside the vacuum vessel of the accelerator. The design of these vane electrodes is similar to that of previous RFQ linacs. Electrical rf power is fed to these electrodes in such a manner that the voltage of each vane is substantially constant along its entire length, and the vane surfaces are shaped so that the electric field produced is approximately purley quadrupole in the region occupied by the particle beam. The distances of the vane surfaces from the beam axis vary along the length of the vanes in the well-known oscillatory fashion so that the beam is focused, adiabatically bunched, and accelerated as the particles travel along the beam axis. The electrodes are connected in shunt to a series of identical lumped variable inductances located at regularly spaced intervals along the vanes, so that the resonant frequency of the loaded vanes, which is the operating frequency of the accelerator, may be varied continuously over a wide range.

Each of these variable inductances comprises a bifilar coil located inside the vacuum vessel on either side of the electrode structure with the axis of the coil parallel to the beam axis. Each filament of the coil is connected to one of the equipotential pairs of electrodes by a flat stem extending from the coil filament to the vane pair, and the stem connecting the other coil filament to the opposite electrode pair is slightly displaced along the beam axis from the first stem. The rf power in each coil is isolated from the voltage ground of the machine. The coils all have the same coaxial helical structure, and to minimize magnetic coupling between the coils, they are alternately disposed on opposite sides of the electrodes as one proceeds along the beam axis, such that the coil axes on each side of the beam are collinear. Each coil includes a shorting bar between the two filaments, which can be moved along the entire length of the coil in order to vary the inductance over a wide range. Thus each coil comprises a variable inductance between the electrodes of opposite polarity. Means are provided for ganging together all of the shorting bars and controlling their position from outside the vacuum vessel, so that the inductances of all of the coils are held to be the same, and so that they may be simultaneously varied while the accelerator is operable.

Electrical rf power is supplied to the structure by a conventional broadband power supply connected to the vanes through a capacitive bridge network. This network includes one or more variable capacitors which can be adjusted to match the output impedance of the power source to the input impedance of the RFQ structure, and to balance the voltages on the vane pairs of opposite polarity relative to ground.

In addition, remotely controlled relay contact switches may be provided at the free ends of each of the bifilar coils, to produce either an open or closed circuit in the sections of the coils beyond the shorting bars. These switches may be used to avoid unwanted interference from resonance modes in these outer sections arising from inductive coupling at the shorting bars. For example, if the switches are open, these remote sections comprise substantially open-ended transmission lines. If the operating frequency is adjusted to a value that is close to a resonance in these open-ended lines, the resonance frequency and electrical reponse of the entire structure may be affected by the interference from these spurious resonances. This can then be corrected by closing the switches, thereby converting the remote sections of the bifilar coils into closed-ended transmission lines of the same length, for which the resonance frequencies will be substantially different.

It is an object of this invention to provide an RFQ linear accelerator which can be operated over a continuously variable range of frequencies, typically from about 10 MHz up to 100 MHz, and that can produce well-focused high-intensity ion beams at various energies for a wide range of ion species.

A second object of this invention is to provide an RFQ linear accelerator having negligible magnetic coupling between different longitudinal sections, so that a variable frequency accelerator having a given design may be constructed of any desired length, simply by adding identical resonating accelerator sections.

Another object of this invention is to provide an RFQ linear accelerator in which the excitation of all resonance modes which could tend to interfere with the primary operation mode at the desired frequency is avoided.

Yet another object of this invention is to provide an RFQ linear accelerator in which the stored electromagnetic energy and currents in the vane electrodes are minimized.

These and other objects, advantages, characteristics and features of this invention may be better understood by examining the following drawings together with the detailed description of the preferred embodiment.

DETAILED DESCRIPTION OF THE PREFERRED EMBODIMENT

Figure 1:
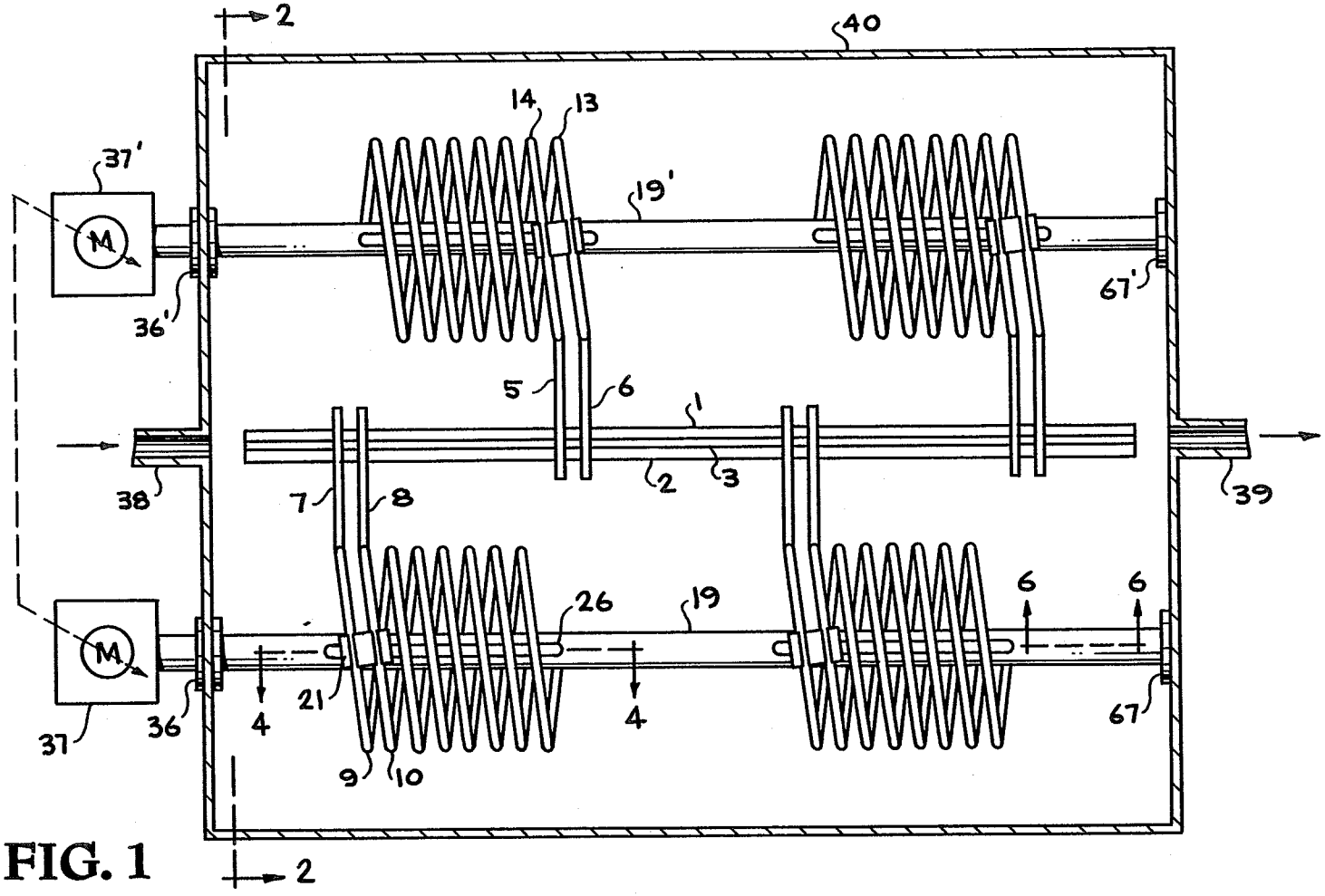
FIG. 1 shows the top view of an RFQ linear accelerator according to the present invention, wherein the upper half of the vacuum vessel and structures attached thereto have been omitted.
Figure 2:
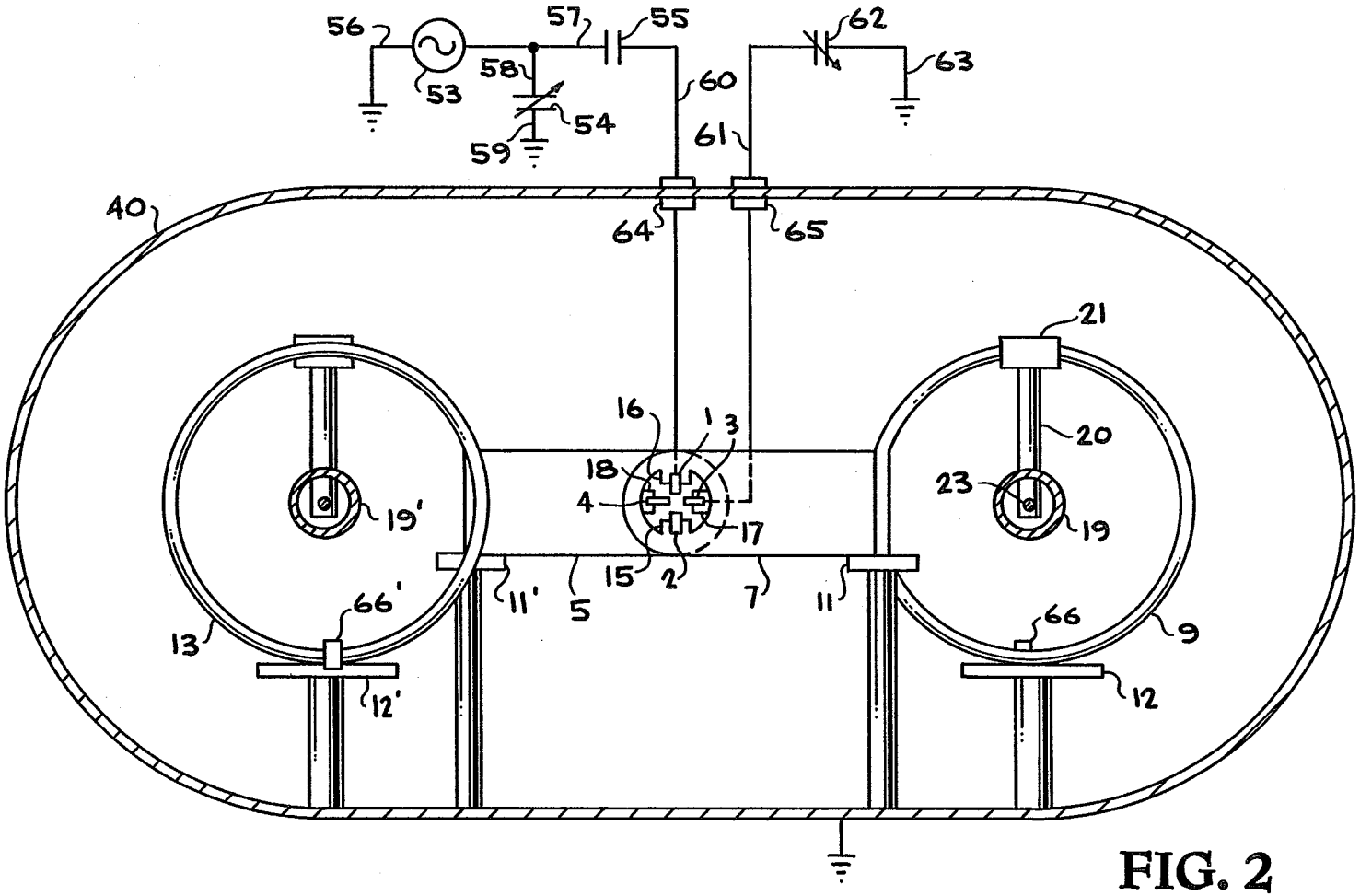
FIG. 2 is a view of the accelerator from the front end, wherein the front wall of the vacuum vessel has been cut away along the lines 2—2 in FIG. 1.
Figure 3:
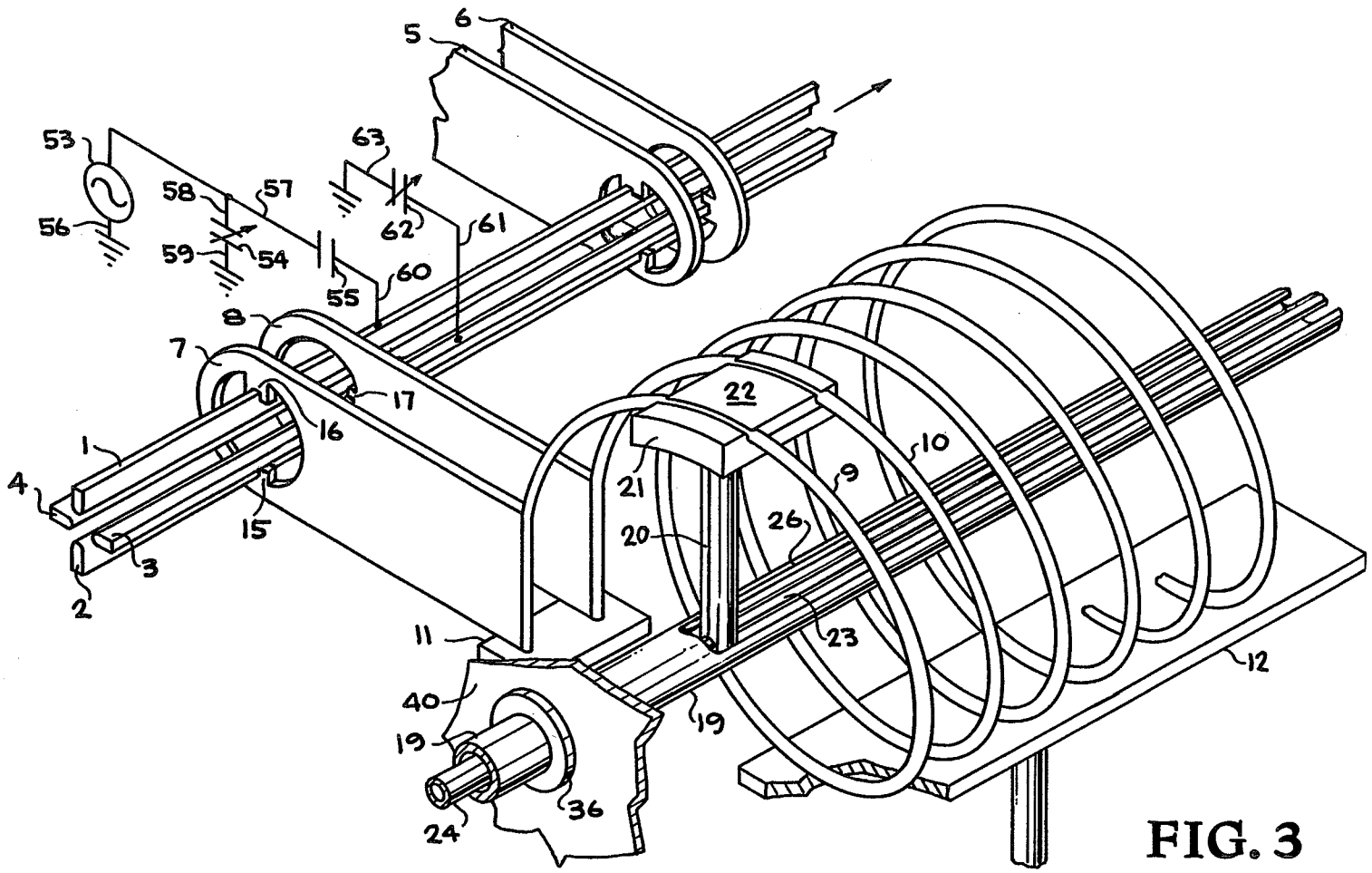
FIG. 3 is a perspective view of the first tuner section of the accelerator, and a portion of the second tuner section, sowing a cutaway portion of the vacuum vessel front wall and support structures.

Referring to FIGS. 1, 2 and 3, the accelerator includes four electrodes, 1–4, comprising long metal vanes disposed around and parallel to the axis of the particle beam, which travels in the direction shown by the arrows. Vanes 1 and 2 lie in the vertical plane containing the beam axis, and these vanes are symmetrically located above and below this axis, and equidistant therefrom. Vanes 3 and 4 lie in a horizontal plane also containing the beam axis, and these vanes are similarly spaced equidistant from this axis, at the same distance as vanes 1 and 2. Thus all four vanes are symmetrically spaced around the particle beam along its entire length. Vanes 1 and 2 are electrically connected together, as are vanes 3 and 4, and the edges of the vanes facing the beam axis are rounded, so that a voltage difference between the two pairs of vanes (1, 2 and 3, 4) will produce a quadrupole electric field in the region between the vanes occupied by the particle beam.

The vanes are supported by pairs of tuner stubs located at periodic intervals along the vanes, and these stubs define a series of tuner sections along the accelerator. The first section is defined by stubs 7 and 8, each of which comprises an elongated conducting plate oriented perpendicular to the beam axis, i.e. in the vertical plane, and extends laterally therefrom in the horizontal direction. Each plate has a circular opening in the end, with the center of this opening lying on the beam axis, and all four vanes extend through this opening. Projecting inward from the edges of each opening are a pair of tabs, or "ears", that are opposed diametrically about the circumference of the opening. For each pair of stubs, one stub opening has a pair of tabs intersecting the vertical plane passing through the beam axis, and the other stub has a pair of tabs cutting the horizontal plane through the beam axis. Each tab supports one of the vanes, the outer edge of which is seated in a "U-shaped" notch in the inner edge of the tab, and is preferably welded or brazed to the tab. Each stub thereby supports and is connected to one pair of diametrically opposite vanes. Thus, referring to FIGS. 2 and 3, stub 7 includes tabs 15 and 16 extending upwardly and downwardly from the opening edge, and these tabs are attached to and support vanes 2 and 1, respectively. Stub 8 is adjacent to, but not in contact with, stub 7, and is located slightly downstream therefrom along the beam axis. Extending inwardly toward the beam from the edge of the circular aperture of stub 8 are tabs 17 and 18 which are attached to and support vanes 3 and 4.

The second tuner section is defined by a pair of tuner stubs 5 and 6 located downstream from the first section, and these stubs are identical in strucure to stubs 7 and 8 and connected to the vanes in the same manner. Thus stub 5 is attached to and supports vanes 1 and 2, and stub 6 is attached to and supports vanes 3 and 4. The orientation of these stubs, however, is the mirror reflection of that of stubs 7 and 8 with respect to the vertical plane passing through the beam axis, so that stubs 5, 6 extend laterally from the beam axis in the direction opposite to that of stubs 7, 8. The third tuner section is adjacent to and downstream from the second tuner section, and the stubs defining it are again identical in structure but oriented as the mirror reflection of the stubs in the second section. Accordingly, the stubs for the first and third tuner sections are identical in structure and orientation, as are the stubs for the second and fourth tuner sections.

The section of the accelerator vanes lying in the second tuner section extends from the midpoint between the first and second pair of stubs to the midpoint between the second and third pair of stubs. Similarly, the midpoint between any two adjacent pairs of tuner stubs defines the boundary between the two corresponding tuner sections of the accelerator. (This definition relies on the fact that the distance between each pair of stubs is very small compared to the distance between pairs of stubs in adjacent tuner sections.) The accelerator vanes in the first section extend upstream from the stubs 7, 8 for a distance equal to half the distance between stubs 5, 6 and 7, 8, and the vanes extend similarly beyond the stubs in the last tuner section for the same distance. Thus all of the tuner sections occupy the same length along the accelerator, and they are all substantially identical in structure. For purposes of illustrative clarity, FIG. 1 shows four tuner sections; however, the accelerator may be constructed with virtually any number of sections, subject only to the inherent limitations of the RFQ design concept for accelerating particle beams at high energies.

Referring still to FIGS. 1–3, the first tuner section includes a pair of circular helical coils, 9, 10, disposed outwardly from the stub ends, each coil having the same radius and both coils having a common helical axis which is parallel to the beam axis and displaced therefrom in the horizontal direction. The filaments of these coils extend around their helical paths in parallel juxtaposition to each other, and each filament is separated from the adjacent turns of the other filament by the same distance at all points along the helical path. These filaments preferably comprise hollow tubing or pipe fabricated from conducting material. One end of each coil, or a section thereof, is soldered to the outer end of one of the tuner stubs, i.e. coil 9 is attached to stub 7 and coil 10 is attached to stub 8, so that in fact the distance between the coil windings is the same as that between the tuner stubs. These coils together form a bifilar inductance connected to the stubs. The coils and stubs are supported by insulated supports, 11 and 12, attached to the outer wall 40 of the device, as shown in FIG. 2. Similar structures 11', 12' support the stubs and coils in the second tuner section, and each of the other tuner sections has insulated supports corresponding to structures 11, 11' and 12, 12'.

Figure 4:
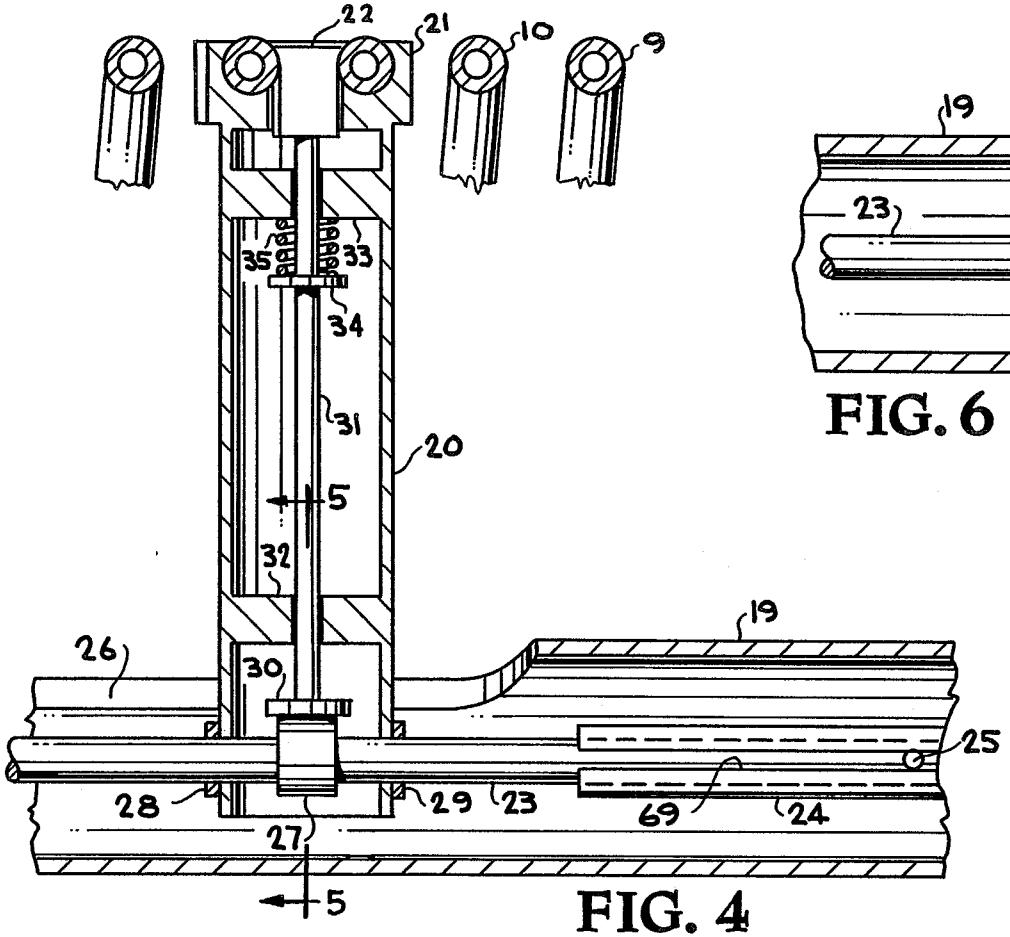
FIG. 4 is a sectional side view of the adjustable shorting bar mechanism taken along the lines 4—4 in FIG. 1.

Each of the bifilar inductance coils has a shorting bar that can be moved along the entire coil. Referring to FIG. 4, as well as FIGS. 1–3, this shorting bar for the first tuner section comprises a block 21 of conducting material having parallel cylinder-like recesses in slidable engagement with the tubular coil filaments 9 and 10. Each recess extends around a portion of the tubular surface of the corresponding coil filament with which it is engaged, but the outermost portion of this surface (facing away from the helical axis) is left exposed, and projects beyond the outermost surface of the block 21 for a slight distance. This projection enables the shorting bar block to slide along the coil past the point where the coil rests on the insulated support 12. Therefore, the position of the shorting bar can be varied by sliding the block along substantially the entire length of the bifilar coil, from the ends of the vane support stubs 9, 10 to the opposite ends of the coil filaments.

The shorting bar block 21 further includes a clamp member 22 fitting into a recess and hole between the recesses for the coil filaments. This clamp member extends into the hole toward the helical axis, and the clamp recess communicates with the coil filament recesses, such that portions of the tubular coil surfaces in the recesses are in facing relation to corresponding clamp surfaces. These facing surfaces are at an oblique angle relative to the helical axis direction, such that the surfaces frictionally engage when the clamp member is urged into the hole toward this axis. In this manner, the clamp member serves to clamp the coil filaments to the shorting bar block.

The position of the shorting bar is controlled by a hollow control rod 20 attached to the shorting bar block 21, and extending radially inward toward the helical axis. A hollow drive shaft 19, having an axis coincident with the helical axis, has a slot 26 perforating its wall and extending along the shaft in a direction parallel to the axis over the entire axial distance occupied by the bifilar coil. The control rod 20 extends through this slot 26 in the drive shaft 19. The inner end of the control rod 20 is supported by a support shaft 23, which also has its axis coincident with the helical axis. The support shaft 23 extends through holes in the inner end of the control rod 20, thereby supporting this control rod. The support shaft 23 is further provided with collars or snap rings, 28, 29, lying on either side of and loosely engaging the control rod 20, such that longitudinal displacement of the control rod 20 causes the support shaft 23 to move parallel to its axis, but nevertheless the support shaft 23 can rotate freely relative to the control rod 20. The shorting bar is thus moved along the bifilar coil filaments by rotation of the drive shaft 19, which causes the edges of the slot to engage the control rod 20 and force it to revolve around the common axis of the helix and the drive and support shafts. As the shorting bar moves along the helical coil windings, the control rod 20 and the support shaft 23 are displaced together longitudinally along the helical axis.

The clamp member 22 is controlled by a clamp rod 31 extending through the interior of the control rod 20 along its axis, and attached to the clamp member 22. The interior of the control rod 20 is provided with collars 32, 33 in relative longitudinal displacement along the rod, and the clamp rod 31 extends through the central openings in these collars. The interior edges of the collars 32, 33 slidably engage and guide the clamp rod 31, so that its displacement is restricted to motion along the axis of the control rod 20. The clamp rod 31 is provided with a collar 34 at a location below the outer collar 33 of the control rod 20, and a coil spring 35 is further provided, extending between and engaging the clamp rod collar 34 and the outer control rod collar 33. The coil spring 35 is wound around the clamp rod 31, and is under compression, so that the spring 35 tends to urge the clamp rod 31 inward toward the helical axis and thereby cause the clamp member 22 to grip the coil filaments 9, 10 by holding them against the shorting bar block 21. The coil spring 35 is preferably of sufficient strength to cause the shorting bar to grip the coil filaments with a pressure of at least 100 pounds per square inch between the contacting surfaces, to allow the shorting bar to carry up to 1200 amperes of current.

Figure 5:
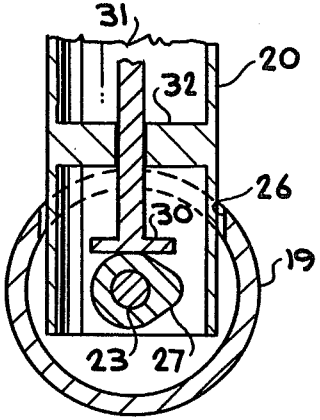
FIG. 5 is a sectional partial end view of the shorting bar mechanism taken along the lines 5—5 in FIG. 4.

Still referring to FIG. 4, as well as to FIG. 5, that portion of the support shaft 23 laying in the interior of the control rod 20 is provided with a cam 27 that is integral with the support shaft 23. The inner end of the clamp rod 31 is provided with a cam follower 30 that rests against and engages the surface of the cam 27. When the the clamp member 22 is in its normal clamped position, the cam is oriented so that the clamp rod 31 is in its inwardmost position, and is held in this position by the spring 35. The clamp is released by rotating the support shaft 23 relative to the drive shaft 19. This causes the cam 27 to force the cam follower 30, the clamp rod 31, and the clamp member 22 outward, away from the helical axis. This enables one to adjust the shorting bar to a new position.

As shown in FIGS. 1 and 2, the axes of the helical bifilar inductance coils on either side of the vanes are all coincident. The drive shaft 19 extends through all of these coils down the length of the accelerator, and is suppported at one end by a journal box that allows the shaft to rotate freely. In FIG. 1 this journal box 67 is attached to the rear wall of the vacuum vessel 40. The opposite end of the drive shaft 19 penetrates the front wall of the vacuum vessel 40 through a journal box 36 that comprises a vacuum rotary joint which supports the vacuum in the vessel interior against the outside atmospheric pressure. One type of such joint that is suitable for the present invention is sold under the registered trademark "Ferrofluidic Seal" by the Ferrofluidics Corporation. This joint enables one to control the drive shaft 19 from the exterior of the vacuum vessel 40.

Figure 6:
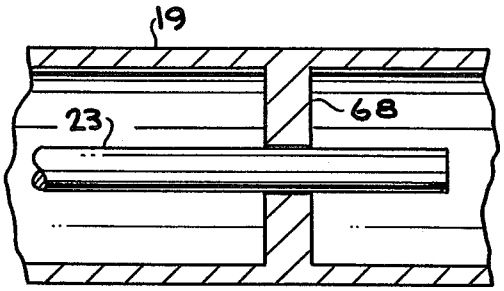
FIG. 6 is another sectional side view of the shorting bar control mechanism taken along the lines 6—6 in FIG. 1.

Still referring to FIGS. 1–5, and also to FIG. 6, each of the helical bifilar inductance coils through which the drive shaft 19 extends is provided with a shorting bar and control mechanism identical to that described above for the first tuner section. The drive shaft 19 has a slot in each tuner section for the shorting bar control mechanism corresponding to the slot 26 in the first tuner section. The support shaft 23 also extends through all of these tuner sections and is supported at its rear end by an internal collar 68 on the interior surface of the drive shaft 19. This collar 68 allows the support shaft 23 to rotate freely relative to the drive shaft 19, and also to slide along its axis.

The front end of the support shaft 23 is supported by a hollow control shaft 24, which is located in the interior of the drive shaft 19 and is coaxial with the support shaft 23 and drive shaft 19. The control shaft 24 extends through the front wall of the vacuum vessel 40 so that it can be controlled from the exterior of the vessel, similarly to the drive shaft 19. The control shaft 24 is supported by a second vacuum rotary joint inside the drive shaft 19 (not shown in the drawings), which allows the control shaft 24 to rotate relative to the drive shaft 19 without loss of vacuum in the vessel 40. The front end of the support shaft 23 fits into the interior of the control shaft 24 and can slide freely along its axis. The interior of the control shaft 24 is provided with a vacuum seal at a location beyond the front end of the support shaft 23 in order to sustain the interior vacuum of the vessel 40. The control shaft 24 is further provided with a slot 69 parallel to its axis through the wall of the shaft, and the support shaft 23 is provided with a pin 25 projecting outward from the support shaft 23 and fitting into the foregoing slot 69 in the control shaft 24. The angular position of the support shaft 23 can thereby be controlled by rotating the control shaft 24. When the drive shaft 19 and this control shaft 24 are rotated togehter, all of the shorting bars controlled by these shafts move along the helical windings in their respective tuner sections, and the support shaft 23 and shorting bar control mechanisms all move lengthwise along the helical axis. When the control shaft 24 is rotated relative to the drive shaft 19, all of the shorting bar clamp members in these tuner sections are released together.

While the foregoing description refers specifically to the shorting bar control mechanisms for the tuner sections on one side of the accelerator vanes, i.e. the first, third, etc. sections, the shorting bars for the tuner sections on the opposite side are controlled by substantially identical mechanisms, including a drive shaft 19' supported by a journal box 67' on the rear wall of the vacuum vessel 40 and extending through a vacuum rotary joint 36' in the front wall of this vessel. A control shaft inside the drive shaft 19', identical to the control shaft 24, is not shown in the drawings. The mechanisms on all of the tuner sections are aligned so that all of the shorting bars are always at the same position on the helical bifilar coils. This requirement implies that the drive shafts 19, 19' and the internal control shafts are coupled together, either mechanically or electrically, so that the shorting bars controlled by both sets of shafts always track each other along their respective sets of helical bifilar coils. In the embodiment described here, the drive shaft 19 and control shaft 24 may be controlled by a positional servomechanism 37, and the drive shaft 19' and corresponding control shaft on the opposite side of the vanes are controlled by a similar positional servomechanism 37'. The two servomechanisms 37 and 37' are ganged together so that the shorting bar control mechanisms on both sides of the accelerator vanes always remain aligned. The structure of the servomechanisms 37, 37' and the methods for coupling them to the shorting bar control mechanisms and ganging them together are known in the relevant art and are not described here in further detail.

The entire structure is enclosed in the vacuum vessel 40, which includes means, not shown in the illustrations, for pumping the vessel interior pressure down to a high vacuum. An entry port 38 is provided in the front wall of the vessel 40 near the front end of the accelerator vanes for injecting a beam of charged particles into the first tuner section in the region between these vanes. The exit port 39 is similarly provided in the rear wall of the vessel 40 near the end of the vanes for removing the accelerated particles from the device. Also not shown in the drawings are the ion soure for producing the charged particles, various beam transport devices for efficient injection of the ions, and evacuated pipes or the like for maintaining the vacuum at the beam ports, all of which are conventional in the art to which this invention pertains. Additionally, apparatus may be provided for pumping coolant through the helical bifilar coil tubes and along the outer surfaces of the vanes and stubs to remove the heat dissipated in these structures.

A remotely controlled mode switch 66 is provided at the remote ends of the two filaments 9, 10 of the bifilar coil in the first tuner section; that is, the ends of the coil filaments that are opposite to the ends connected to the tuner stubs 7, 8. This switch 66 allows the remote ends of these coil filaments to be electrically connected or disconnected. A similar mode switch 66' is provided at the remote ends of the filaments 13, 14 of the bifilar coil in the second tuner section, and corresponding mode switches are provided for the coil filaments in all of the other tuner sections. Means are further provided, not shown in the drawings, for electrically ganging these mode switches so that they are all opened or closed together.

Still referring to FIGS. 2 and 3, electrical power is supplied to the accelerator by a broadband rf osciallator 53, one terminal of which is grounded by conductor 56. The other terminal of this oscillator is connected by a conductor 57 to one side of a coupling capacitor 55. The other side of this capacitor 55 is connected through a feeder wire 60 to the vane 1, preferably at the boundary location between two of the tuner sections. The vacuum vessel 40 is grounded, and the feeder wire 60 passes through an insulated rf feedthrough 64 which is provided in the wall of the vacuum vessel 40. The voltage terminal of the oscillator 53 is also connected through conductors 57, 58, to one terminal of a variable capacitor 54, and the other terminal of this capacitor 54 is connected through conductor 59 to ground.

The feeder wire 60, being connected directly to the vane 1, is also connected to the diametrically opposite vane 2 through the tuner stubs 5, 7, etc., that support and connect these vanes. A second feeder wire 61 is connected directly to vane 3, also at the boundary point between tuner sections, and indirectly to vane 4 through tuner stubs 6, 8, etc. This second feeder wire 61 passes through a second insulated rf feed through 65 which is also provided in the wall of the vacuum vessel 40. The feeder wire 61 is connected to one terminal of a variable capacitor 62. The opposite terminal of this variable capacitor 62 is connected through conductor 63 to ground, thus completing the power supply circuit.

From the foregoing circuit description together with the associated drawings it will be appreciated that the rf power supply is coupled to the accelerator through a capacitive bridge network, where the accelerator vanes and associated tuner sections represent one arm of the bridge. The variable capacitor 54 may be adjsuted to provide impedance matching from the power supply to the rest of the circuit. The other variable capacitor 62 may be adjusted to balance the voltages on the two pairs of vanes with respect to ground. When this balance is achieved, the magnitude of the rf voltages on each pair of vanes is the same, and the dc voltage of the vanes is zero. since the circuit as described above results in dc isolation of the accelerator vanes, tuner stubs and helical bifilar inductance coils with respect to ground, and the entire control mechanism for the shorting bars is nonconducting, it is desirable to provide a dc ground for these elements. This ground preferably comprises one or more rf chokes, not shown in the drawings, each of which is connected to the remote end of one of the bifilar inductance coil filaments.

It is also desirable to minimize the volume of the vacuum vessel 40 without bringing the bifilar inductance coils unnecessarily close to the vessel walls, which would produce stray capacitance effects. The optimal arrangement of the helical bifilar inductance coils is shown in FIG. 1. The helixes formed by the coils in the first and third tuner sections extend axially downstream, away from the front wall of the vacuum vessel. Similarly the helixes formed by the coils in the second and fourth tuner sections extend axially upstream, away from the rear wall of the vessel 40. In addition, it is desirable to provide an even number of tuner sections, with the corresponding inductance coils of each successive pair of sections alternately and symmetrically disposed on either side of the accelerator vanes. This configuration makes economical use of the space within the vacuum vessel 40, and allows the ends of the accelerator vanes to be brought reasonably close to the ports in the walls of the vessel to avoid unnecessary losses of beam current.

Figure 7:
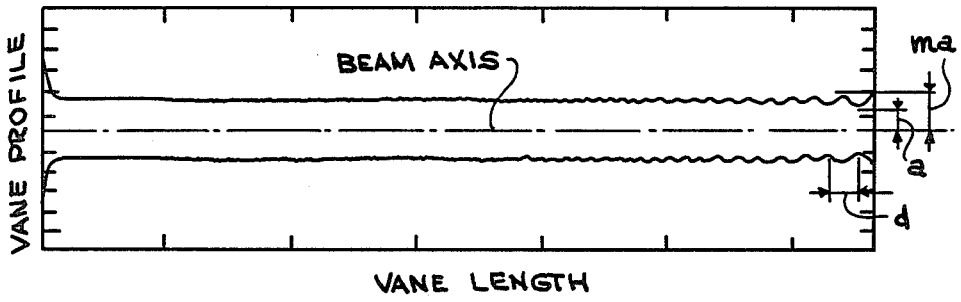
FIG. 7 illustrates schematically the typical profiles of the inner surfaces of two RFQ accelerator vanes lying in a plane passing through the particle beam central axis.

FIG. 7 shows schematically the profile of the surfaces of one pair of diametrically opposed vanes, projected onto a plane passing through the beam axis. In this diagram the transverse scale is greatly expanded relative to the longitudinal scale. At any instant of time both vanes have the same rf voltage, which is ideally uniform along the entire length of the vanes, and the voltage on the adjacent pair of vanes is equal in magnitude and opposite in sign. When the surfaces of the vanes are at a uniform distance from the beam axis along the length of the vanes, an electric field is produced which is purely transverse to the beam axis, and is primarily quadrupole. In a given plane passing through the beam axis, this electric field is focusing during one-half of the rf period and defocusing during the other half. The particle beam is therefore exposed to an electric field that produces alternating gradient focusing with a strength independent of the particle velocity.

In order to generate bunching and acceleration of the particle beam, the radial distance between the beam axis and the surface of each electrode vane is varied periodically as a function of distance along the axis, with vanes 1 and 2 at a minimum radius, a, when vanes 3 and 4 are at a maximum radius, ma, where "m" is defined as the radius modulation parameter and is always equal to or greater than 1. As discussed previously, the distance d between two radius maxima, or ripple crests, encompasses two unit cells, and at any given time adjacent unit cells have oppositely directed axial electric fields. Therefore every alternate cell contains a particle bunch. The gradual increase of the radial modulation parameter with axial distance produces adiabatic bunching of the particle beam with a high capture efficiency.

In addition, the particles undergo acceleration as they progress along the beam axis, and therefore the length of the unit cell must be gradually increased with axial distance. For these reasons the variation of the vane surface profile with vane length is actually "quasi-periodic", as shown in FIG. 7. The detailed procedure for determining the vane surface profile in a given case has been described previously by K. R. Crandall, R. H. Stokes and T. P. Wangler ("RF Quadrupole Beam Dynamics Design Studies", Proceedings of the Tenth Linear Accelerator Conference, Montauk, New York (Sept. 10–14, 1979); Brookhaven National Laboratory Report No. BNL-51134 (1980), p. 205). The actual vane surfaces are fabricated with a computer-controlled vertical milling machine, utilizing the known techniques described by these and other authors.

From the foregoing description it will be appreciated that the accelerator structure disclosed herein comprises a plurality of coupled tunable LC oscillator circuits, each oscillator being defined by one of the tuner sections. The tuner sections are ideally identical and each tuner section can be modeled as an inhomogeneous transmission line terminated by a short circuit at one end (the shorting bar) and an open circuit at the other end (the vane electrodes at the tuner section boundaries). Thus at resonance each tuner section can be viewed as a "quarter-wave" line. The line has three parts, namely the helical bifilar coil, the tuner stubs, and the vane electrodes between the tuner section boundaries. Each part of the line is a four-terminal network with its own transfer function matrix, and these networks are connected in series. The inductance of each oscillator circuit is largely concentrated in the helical bifilar inductance coils, and the capacitance is primarily distributed between the tuner stubs and the vane electrodes. The rf voltage maxima occur at the boundaries between adjacent tuner sections, where the current between sections vanishes when the sections are properly aligned. Conversely the rf current maximum is at the inductance shorting bar, where the voltage is vanishingly small. The resonant frequencies of the tuner sections are ideally all the same and constitute the frequency of the fundamental resonance mode of the coupled system of oscillators, which is the operating frequency of the accelerator. This frequency may be selected and varied by moving the shorting bars on all of the helical bifilar inductance coils to the same position to obtain the inductance required to cause all of the tuner sections to resonate at the desired frequency.

From this model it is apparent that the fundamental resonant frequency of the system can be determined by considering one tuner section independently from the others, and this frequency corresponds to the mode in which the vane voltages for all tuner sections are in phase with each other. In this mode the current along the vanes is minimized, and within the vanes themselves this mode can be viewed as an externally driven "TEM" mode. Considering the vanes as a balanced 4 wire transmission line, the next resonant mode has a phase shift of 180° in the voltage on each vane between the ends of the vane. This frequency of this resonance is always much higher than the fundamental resonance frequency, and therefore the interference from this mode and all higher resonant modes is negligible.

Furthermore the design of this system minimizes the inductive coupling between different tuner sections. In each section the major portion of inductive impedance is concentrated in the bifilar tuner coils, while the tuner circuit capacitance is mostly in the vanes and tuner stubs. This implies that the magnetic field energy storage and the currents are largely in the coils, while the electric fields are primarily in the vanes and tuner stubs. The tuner coils in adjacent sections are disposed on opposite sides of the vanes to avoid any mutual inductance between different coils. Interference between tuner sections can be further avoided by increasing the length of each section. However one pays a price for this increase in that the voltage variation along the vanes is correspondingly increased. At a given frequency the ratio of the voltage at the tuner stub to the voltage at the tuner section boundary is given by the cosine of 180° times the ratio of the tuner section length divided by the propagation wavelength along the vanes. Thus, the length of the tuner sections must be limited to a value for which this cosine does not differ appreciably from unity at the highest operating frequency of the system. Furthermore, if the length of the tuner sections is less than a quarter wavelength for the highest frequency, then the vane impedance is capacitive over the entire frequency range. By minimizing the voltage gradients and currents in the vanes, this design allows one to use vane materials of higher resistivity, such as aluminum.

Within a given tuner section, interference can arise at certain operating frequencies from the remote portion of the bifilar helical coil. The part of the coil from the shorting bar to the remote end can be viewed as a transmission line that is terminated by the mode switch 66, 66'. The large rf currents in the shorting bar can excite resonant modes in this line, which may be close to the operating frequency. The mode switches are provided to avoid this problem. For example, if the switches are closed and the operating frequency is adjusted to a value that happens to be near the quarter-wave resonance of the remote portion of the coil, the coupling to this portion can be undesirably large. In this event, the mode switches are opened, and the nearest resonance of the remote portion of the coil becomes the half-wavelength mode, which will have a substantially different frequency and cause negligible interference. Similarly, interference from the open-switch modes can be avoided by closing the mode switches.

Further advantages of this system are provided by the capacitive coupling of the power supply. Although in principle power could be supplied to this system by means of magnetic coupling with current loops and the like, it is difficult to provide such coupling means at the shorting bars where this technique would be most efficient. The more practical method is by the direct coupling of the power supply to the vanes, which reduces the elecromagnetic perturbation and stray interference with the resonant system. Furthermore it gives rise to less power dissipation and ohmic heating, since it draws less current from the power supply. To obtain maximum coupling efficiency, the power supply is connected at a position along the vanes where the rf voltage is at a maximum, namely at one of the boundaries between two adjacent tuner sections or at the end of a vane.

The preferred embodiment of the invention is not limited to four tuner sections as illustrated in FIG. 1. A particular example may have eight sections with a total vane length of 2.4951 meters. In this case, the tuner stubs are typically 26.7 centimeters in length and 88.9 millimeters wide, having a thickness of ¼ inch. The helical inductance coils comprise 6 turns of diameter 12.5 inches, or approximately 6 meters total length. The coil filaments are half-inch copper tubing. The surface of the vanes facing the beam axis has a radius of curvature of 2.38 millimeters. The minimum distance of this surface from the beam axis is 1.892 millimeters, and the average distance from the beam axis is 3.175 millimeters.

Using these geometrical parameters, the detailed design of the vane surfaces may be carried out by known techniques for RFQ linear accelerators. The vanes may be described elecrically as two symmetrical 4-wire transmission lines connected in shunt, and terminated by an open circuit. The tuner stubs may each be treated as a parallel plate transmission line. The helical bifilar inductance coil can be modeled by an open 2-wire transmission line. The accuracy of this approximation has been verified by construction of a prototype tuner section having a helical bifilar inductance coil with a movable shorting bar, connected to tuner stubs and vanes according to the within disclosure. Measurements have been made of the resonant frequencies of the prototype system for various positions of the shorting bar. It is found that the above transmission line model predicts the observed resonance frequency to within an accuracy of plus or minus 10 percent.

Figure 8:
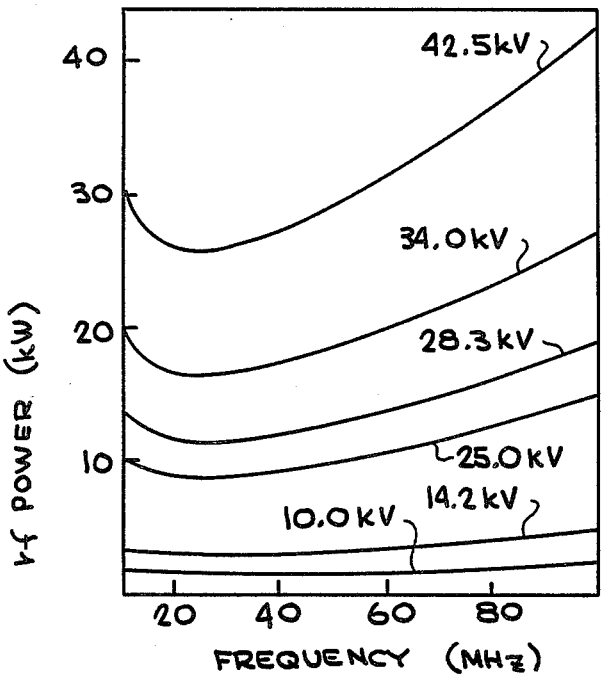
FIG. 8 is a graph of the electrical radio-frequency power required to operate the device as a function of the frequency for various rf voltages between the accelerator vanes, according to the embodiment set forth in the detailed description.
Figure 9:
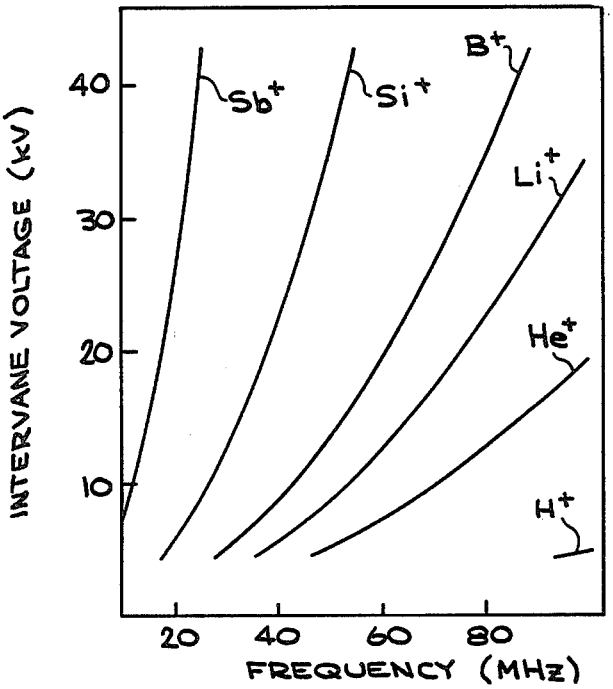
FIG. 9 is a graph of the rf voltage between the accelerator vanes plotted against the frequency for various species of accelerated ions, according to the embodiment set forth in the detailed description.
Figure 10:
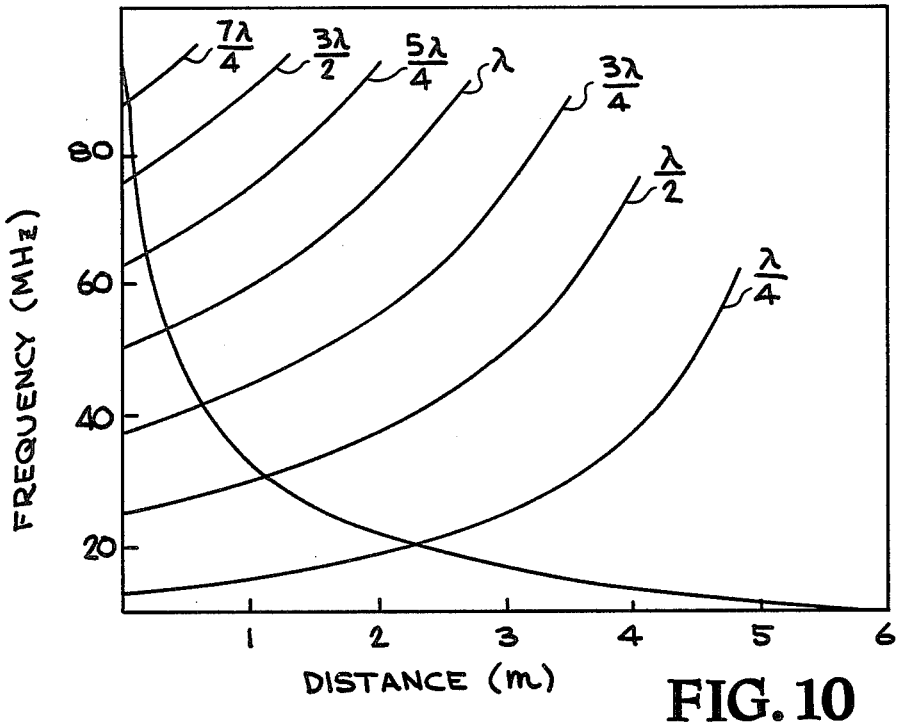
FIG. 10 is a mode chart of the resonance frequencies of the remote tuner sections and the operating frequency of the accelerator as a function of the distance of the tuner shorting bars from the support stubs, according to the embodiment set forth in the detailed description.

Using the transmission line model and the above parameters, the rf power required to drive the system may be calculated. FIG. 8 shows a graph of this rf power as a function of the operating frequency for various intervane voltages. Of course, as the operating frequency is varied for a given ion, the intervane voltage must also be varied to ensure that the transit time of the ion through a unit cell is synchronized with the frequency. In FIG. 9 the required intervane voltage is plotted as a function of frequency for various different ion species. The frequency range available is determined by the distance over which the shorting bar can be moved. FIG. 10 shows a graph of the resonant frequency of the above-described system as a function of the distance of the shorting bar from the tuner stub. Also shown are the resonant frequencies of the remote coil portions. For this coil configuration one can obtain operating frequencies ranging from less than 10 MHz up to 100 MHz.

For any given ion species in a system with the above design parameters the maximum beam current that can be accelerated may be calculated using known methods. A computer program that implements these methods, entitled "CURLI", has been developed at Los Alamos National Laboratory, and the theoretical formulation for these calculations is described by T. P. Wangler, "Space-Charge Limits in Linear Accelerators", Los Alamos Report LA-8388 (December, 1980). This computer program has been used to carry out a calculation of the saturated beam current for the above-described embodiment of this invention for a variety of ion species and energies.

Table I shows the results of these calculations for several representative ion types, together with typical values for the input and output ion energies, and corresponding values for the rf power required to operate the system, the operating frequency, and the intervane voltage. The figures in Table I indicate that the particular system described above is capable of producing ion beams from $H^+$ through $U^{++}$ over a range of ion energies from a few hundred keV up to several MeV. The maximum intervane voltage shown in this Table is 42.5 kV. Maximum beam currents available from this system range from approximately 0.1–10 milliamperes.

From the results in Table I it is readily apparent that this invention finds usefulness in a wide variety of practical applications, including ion implantation in materials, radiation biology, and particle beam injection into cyclotrons and other larger accelerators. The foregoing description of a preferred embodiment of the invention and the particular parameters and calculations have been presented for purposes of illustration and description. They are not intended to be exhaustive or to limit the invention to the precise form disclosed, and, obviously, many modifications and variations are possible in light of the above teaching. The embodiment was chosen and described in order to best explain the principles of the invention and its practical applications to thereby enable others skilled in the art to best utilize the invention in various embodiments and with various modifications as are suitable to the particular use contemplated. It is intended that the spirit and scope of the invention are to be defined by reference to the claims appended hereto.

TABLE 1

| Ion Specie | q/m | Injection Voltage (kV) | Input Ion Energy (keV/amu) | Final Ion (keV/amu) | Energy (keV) | RF Power (kW) | Operating Frequency (MHz) | Intervane Voltage (kV) | Beam Current Limit (ma) |
|---|---|---|---|---|---|---|---|---|---|
| $H^+$ | 1 | 10.00 | 10.000 | 150.000 | 150.00 | 0.403 | 93.808 | 4.25 | 1.28 |
| | | 11.36 | 11.364 | 170.455 | 170.46 | 0.552 | 100.000 | 4.83 | 1.55 |
| $He^+$ | 1/4 | 10.00 | 2.50 | 37.50 | 150.0 | 0.287 | 46.904 | 4.25 | 0.6 |
| | | 26.67 | 6.67 | 100.00 | 400.0 | 2.500 | 76.594 | 11.33 | 2.8 |
| | | 45.45 | 11.364 | 170.455 | 681.8 | 8.832 | 100.000 | 19.32 | 6.2 |
| $Li^+$ | 1/7 | 10.00 | 1.429 | 21.429 | 150.0 | 0.268 | 35.456 | 4.25 | 0.5 |
| | | 33.33 | 4.762 | 71.429 | 500.0 | 3.592 | 64.734 | 14.17 | 2.95 |
| | | 79.55 | 11.364 | 170.465 | 1193.2 | 26.939 | 100.000 | 33.81 | 10.9 |
| $B^+$ | 1/11 | 10.00 | 0.909 | 13.636 | 150.0 | 0.260 | 28.284 | 4.25 | 0.4 |
| | | 33.33 | 3.030 | 45.455 | 500.0 | 3.289 | 51.640 | 14.17 | 2.4 |
| | | 66.67 | 6.061 | 90.909 | 1000.0 | 15.237 | 73.030 | 28.33 | 6.7 |
| | | 100.0 | 9.091 | 136.364 | 1500.0 | 38.862 | 89.443 | 42.50 | 12.3 |
| $N^+$ | 1/14 | 10.00 | 0.714 | 10.714 | 150.0 | 0.259 | 25.071 | 4.25 | 0.34 |
| | | 33.33 | 2.381 | 35.714 | 500.0 | 3.166 | 45.774 | 14.17 | 2.1 |
| | | 66.67 | 4.762 | 71.428 | 1000.0 | 14.368 | 64.733 | 28.33 | 5.9 |
| | | 100.0 | 7.143 | 107.14 | 1500.0 | 35.892 | 79.282 | 42.50 | 10.9 |
| $Ne^+$ | 1/20 | 10.00 | 0.500 | 7.50 | 150.0 | 0.261 | 20.976 | 4.25 | 0.3 |
| | | 33.33 | 1.667 | 25.00 | 500.0 | 3.028 | 38.297 | 14.17 | 1.75 |
| | | 66.67 | 3.333 | 50.00 | 1000.0 | 13.374 | 54.160 | 28.33 | 4.95 |
| | | 100.00 | 5.000 | 75.00 | 1500.0 | 32.694 | 66.332 | 42.50 | 9.1 |
| $Si^+$ | 1/28 | 10.00 | 0.357 | 5.357 | 150.0 | 0.266 | 17.728 | 4.25 | 0.24 |
| | | 33.33 | 1.190 | 17.875 | 500.0 | 2.940 | 32.367 | 14.17 | 1.5 |
| | | 66.67 | 2.381 | 35.714 | 1000.0 | 12.918 | 45.774 | 28.33 | 4.2 |
| | | 100.00 | 3.571 | 53.571 | 1500.0 | 30.478 | 56.061 | 42.50 | 7.7 |
| $P^+$ | | 10.00 | 0.323 | 4.839 | 150.0 | 0.268 | 16.848 | 4.25 | 0.23 |
| | | 33.33 | 1.075 | 16.129 | 500.0 | 2.920 | 30.761 | 14.17 | 1.4 |
| | | 66.67 | 2.151 | 32.258 | 1000.0 | 12.488 | 43.508 | 28.33 | 4.0 |

TABLE 1-continued

| Ion Specie | q/m | Injection Voltage (kV) | Input Ion Energy (keV/amu) | Final Ion (keV/amu) | Energy (keV) | RF Power (kW) | Operating Frequency (MHz) | Intervane Voltage (kV) | Beam Current Limit (ma) |
|---|---|---|---|---|---|---|---|---|---|
| | | 100.00 | 3.226 | 48.387 | 1500.0 | 29.920 | 53.279 | 42.50 | 7.3 |
| $As^+$ | 1/75 | 10.00 | 0.133 | 2.000 | 150.0 | 0.300 | 10.832 | 4.25 | 0.15 |
| | | 33.33 | 0.444 | 6.666 | 500.0 | 2.908 | 19.777 | 14.17 | 0.2 |
| | | 66.67 | 0.888 | 13.333 | 1000.0 | 11.589 | 27.968 | 28.33 | 2.6 |
| | | 100.00 | 1.333 | 20.000 | 1500.0 | 26.680 | 34.254 | 42.50 | 4.7 |
| $Sb^+$ | 1/121 | 13.333 | 0.110 | 1.653 | 200.0 | 0.550 | 9.847 | 5.67 | 0.18 |
| | | 33.333 | 0.275 | 4.132 | 500.0 | 3.017 | 15.570 | 14.17 | 0.7 |
| | | 66.667 | 0.551 | 8.264 | 1000.0 | 11.568 | 22.019 | 28.33 | 2.0 |
| | | 100.00 | 0.826 | 12.397 | 1500.0 | 26.019 | 26.968 | 42.50 | 3.7 |
| $U^{++}$ | 2/238 | 13.333 | 0.112 | 1.681 | 400.0 | 0.547 | 9.930 | 5.67 | 0.18 |
| | | 16.666 | 0.140 | 2.101 | 500.0 | 0.829 | 11.102 | 7.08 | 0.25 |
| | | 33.333 | 0.280 | 4.202 | 1000.0 | 3.014 | 15.700 | 14.17 | 0.7 |
| | | 66.667 | 0.560 | 8.403 | 1500.0 | 11.565 | 22.204 | 28.33 | 2.0 |
| | | 100.00 | 0.840 | 12.605 | 3000.0 | 26.032 | 27.194 | 42.50 | 3.7 |

What is claimed is:

1. A variable frequency RFQ linear accelerator for accelerating, focusing or bunching a beam of charged particles, comprising:

an evacuated vessel through which said beam of charged particles travels:

an even-numbered plurality of elongated electrodes, supported within said vessel in parallel relation to the trajectory of said beam of charged particles, said elecrodes being disposed azimuthally around said trajectory, said electrodes further having a structrue such that they produce an RFQ electric field useful for accelerating, focusing or bunching said beam of charged particles;

power supply means connected to said electrodes for supply radio-frequency elecrical power thereto, such that said electrodes are caused to generate said RFQ elecctric field by said power supply means;

variable inductance means having an inductance which may be varied over a substantial range, said variable inductance means being electrically communicative with said electrodes, such that said variable inductance means and said electrodes form an LC resonant circuit which oscillates at the frequency desired for said RFQ electric field, and said frequency may be varied by varying the inductance of said variable inductance means; and inductance control means connected to said variable inductance means such that the inductance of said variable inductance means may be controlled from the exterior of said evacuated vessel.

2. A variable frequency RFQ linear accelerator as recited in claim 1, wherein said variable inductance means comprises a plurality of inductive circuit elements, each such element having a variable inductance, said elements being connected at spatial intervals to said elecrodes, such that each of said elements together with a portion of said electrodes forms an LC resonant circuit which oscillates at the frequency desired for said RFQ electric field; and wherein said inductance control means comprises a plurality of element control means, each being connected to one of said inductive circuit elements, such that the inductance of said element may be controlled by said element control means, said plurality of element control means being further connected together such that the resonant frequencies of all of said LC resonant circuits are maintained equal to each other as the inductance of said elements is varied.

3. A variable frequency RFQ linear accelerator as recited in claim 2, wherein said power supply means comprises:

a power generator having a voltage terminal that supplies a radio-frequency electrical voltage at a variable frequency; and a capacitive impedance having one terminal connected to said voltage terminal and having an opposite terminal connected to said electrodes, such that the impedance of said power supply means at said electrodes is capactive.

4. A variable frequency RFQ linear accelerator as recited in claim 2, wherein each of said inductive circuit elements comprises:

a helical bifilar inductance coil, one end of each filament of said coil being connected to one-half of the members of said even-numbered plurality of electrodes; and a shorting bar movably connected between the two filaments of said helical bifilar inductance coil, said shorting bar having clamping means for securely clamping said shorting bar to said filaments to provide a conducting path for large electrical currents, and for releasing said shorting bar so that said shorting bar may be moved to a plurality of positions along the length of said coil filaments, said shorting bar and clamping means being connected to and controlled by said element control means, whereby the inductance of said coil may be varied and controlled from the exterior of said evacuated vessel.

5. A variable frequency RFQ linear accelerator as recited in claim 4, wherein said power supply means comprises:

a power generator having a voltage terminal that supplies a radio-frequency electrical voltage at a variable frequency; and a capacitive impedance having one terminal connected to said voltage terminal and having an opposite terminal connected to said electrodes, such that the impedance of said power supply means at said electrodes is capacitive.

6. A variable frequency RFQ linear accelerator as recited in claim 4, wherein each of said inductive circuit elements further comprises a switch connected between the filament ends of said coil opposite to the ends of said coil filaments connected to said electrodes, said switches being ganged and remotely controlled, whereby the remote portion of said coil beyond said shorting bar may be terminated by said switch in an open or closed circuit.

7. A variable frequency RFQ linear accelerator as recited in claim 4, wherein the helical bifilar inductance coils of said inductive circuit elements are disposed at a plurality of azimuthal angles around the axis of the beam trajectory, such that the axes of the coil helixes are parallel to said trajectory, and further such that the axes of all of said coils disposed at the same azimuthal angle are coincident.

8. A variable frequency RFQ linear accelerator as recited in claim 7, wherein said power supply means comprises:

a power generator having a voltage terminal that supplies a radio-frequency electrical voltage at a variable frequency; and a capacitive impedance having one terminal connected to said voltage terminal and having an opposite terminal connected to said electrodes, such that the impedance of said power supply means at said electrodes is capacitive.

9. A variable frequency RFQ linear accelerator as recited in claim 7, wherein each of said inductive circuit elements further comprises a switch connected between the filament ends of said coil opposite to the ends of said coil filaments connected to said electrodes, said switches being ganged and remotely controlled, whereby the remote portion of said coil beyond said shorting bar may be terminated by said switch in an open or closed circuit.

10. A variable frequency RFQ linear accelerator as recited in claim 7, wherein the helical bifilar inductance coils of said inductive circuit elements for which the corresponding portions of the electrodes forming said LC resonant circuits are adjacent are disposed on opposite sides of said axis of said beam trajectory.

11. A variable frequency RFQ linear accelerator as recited in claim 10, wherein said power supply means comprises:

a power generator having a voltage terminal that supplies a radio-frequency electrical voltage at a variable frequency; and a capacitive impedance having one terminal connected to said voltage terminal and having an opposite terminal connected to said electrodes, such that the impedance of said power supply means at said electrodes is capacitive.

12. A variable frequency RFQ linear accelerator as recited in claim 10, wherein each of said inductive circuit elements further comprises a switch connected between the filament ends of said coil opposite to the ends of said coil filaments connected to said electrodes, said switches being ganged and remotely controlled, whereby the remote portion of said coil beyond said shorting bar may be terminated by said switch in an open or closed circuit.

13. A variable frequency RFQ linear accelerator as recited in claim 7, wherein said plurality of element control means comprises:

for each of said coincident helical coil axes, a drive shaft member having an axis coincident with said coil axis and extending through each of said helical coils having said axis, said drive shaft member being capable of rotation about said axis, said drive shaft member further extending through the wall of said vessel such that the angular position of said drive shaft member may be controlled from the exterior of said vessel;

for each of said helical coils, a control rod member extending radially from said drive shaft member to said shorting bar and connected thereto, said control rod member being engaged by said drive shaft member such that the position of said shorting bar may be controlled by rotation of said drive shaft member; and connecting means between all of said drive shaft members, such that the angular positions of said drive shaft members are maintained in cooperative relation to each other so that the resonant frequencies of all of said LC resonant circuits are the same.

14. A variable frequency RFQ linear accelerator as recited in claim 13, wherein said power supply means comprises:

a power generator having a voltage terminal that supplies a radio-frequency electrical voltage at a variable frequency; and a capacitive impedance having one terminal connected to said voltage terminal and having an opposite terminal connected to said electrodes, such that the impedance of said power supply means at said electrodes is capacitive.

15. A variable frequency RFQ linear accelerator as recited in claim 13, wherein each of said inductive circuit elements further comprises a switch connected between the filament ends of said coil opposite to the ends of said coil filaments connected to said electrodes, said switches being ganged and remotely controlled, whereby the remote portion of said coil beyond said shorting bar may be terminated by said switch in an open or closed circuit.

16. A variable frequency RFQ linear accelerator as recited in claim 13, wherein said clamping means comprises a clamp member engaging said coil filaments such that said filaments are frictionally clamped by said clamp member pressing said filaments against said shorting bar, and wherein said plurality of element control means further comprises:

for each of said inductive circuit elements, a clamp rod member extending radially from said helical coil axis to said clamp member;

for each of said inductive circuit elements, spring means connecting said clamp rod member to said control rod member and urging said clamp rod member such that said clamp member is caused to press against said filaments by said spring means;

for each of said coincident oil axes, a support shaft member having an axis coincident with said drive shaft member and further having, for each clamp rod member extending from said axis, a cam engaged by the end of said clamp rod member at said axis, such that said clamp member may be controlled by movement of said support shaft member; and means for controlling all of said support shaft members from the exterior of said evacuated vessel.

17. A variable frequency RFQ linear accelerator as recited in claim 16, wherein said power supply means comprises:

a power generator having a voltage terminal that supplies a radio-fequency electrical voltage at a variable frequency; and a capacitive impedance having one terminal connected to said voltage terminal and having an opposite terminal connected to said electrodes, such that the impedance of said power supply means at said electrodes is capacitive.

18. A variable frequency RFQ linear accelerator as recited in claim 16, wherein each of said inductive circuit elements further comprises a switch connected between the filament ends of said coil opposite to the ends of said coil filaments connected to said electrodes, said switches being ganged and remotely controlled, whereby the remote portion of said coil beyond said shorting bar may be terminated by said switch in an open or closed circuit.

19. A variable frequency RFQ linear accelerator as recited in claim 1, wherein said frequency of oscillation may be varied over a range such that the maximum frequency exceeds the minimum frequency by a ratio substantially greater than 3 to 1.

20. A variable frequency RFQ linear accelerator as recited in claim 2, wherein said frequency of oscillation may be varied over a range such that the maximum frequency exceeds the minimum frequency by a ratio substantially greater than 3 to 1.

21. A variable frequency RFQ linear accelerator as recited in claim 3, wherein said frequency of oscillation may be varied over a range such that the maximum frequency exceeds the minimum frequency by a ratio substantially greater than 3 to 1.

22. A variable frequency RFQ linear accelerator as recited in claim 4, wherein said frequency of oscillation may be varied over a range such that the maximum frequency exceeds the minimum frequency by a ratio substantially greater than 3 to 1.

23. A variable frequency RFQ linear accelerator as recited in claim 5, wherein said frequency of oscillation may be varied over a range such that the maximum frequency exceeds the minimum frequency by a ratio substantially greater than 3 to 1.

24. A variable frequency RFQ linear accelerator as recited in claim 6, wherein said frequency of oscillation may be varied over a range such that the maximum frequency exceeds the minimum frequency by a ratio substantially greater than 3 to 1.

25. A variable frequency RFQ linear accelerator as recited in claim 7, wherein said frequency of oscillation may be varied over a range such that the maximum frequency exceeds the minimum frequency by a ratio substantially greater than 3 to 1.

26. A variable frequency RFQ linear accelerator as recited in claim 8, wherein said frequency of oscillation may be varied over a range such that the maximum frequency exceeds the minimum frequency by a ratio substantially greater than 3 to 1.

27. A variable frequency RFQ linear accelerator as recited in claim 9, wherein said frequency of oscillation may be varied over a range such that the maximum frequency exceeds the minimum frequency by a ratio substantially greater than 3 to 1.

28. A variable frequency RFQ linear accelerator as recited in claim 10, wherein said frequency of oscillation may be varied over a range such that the maximum frequency exceeds the minimum frequency by a ratio substantially greater than 3 to 1.

29. A variable frequency RFQ linear accelerator as recited in claim 11, wherein said frequency of oscillation may be varied over a range such that the maximum frequency exceeds the minimum frequency by a ratio substantially greater than 3 to 1.

30. A variable frequency RFQ linear accelerator as recited in claim 12, wherein said frequency of oscillation may be varied over a range such that the maximum frequency exceeds the minimum frequency by a ratio substantially greater than 3 to 1.

31. A variable frequency RFQ linear accelerator as recited in claim 13, wherein said frequency of oscillation may be varied over a range such that the maximum frequency exceeds the minimum frequency by a ratio substantially greater than 3 to 1.

32. A variable frequency RFQ linear accelerator as recited in claim 14, wherein said frequency of oscillation may be varied over a range such that the maximum frequency exceeds the minimum frequency by a ratio substantially greater than 3 to 1.

33. A variable frequency RFQ linear accelerator as recited in claim 15, wherein said frequency of oscillation may be varied over a range such that the maximum frequency exceeds the minimum frequency by a ratio substantially greater than 3 to 1.

34. A variable frequency RFQ linear accelerator as recited in claim 16, wherein said frequency of oscillation may be varied over a range such that the maximum frequency exceeds the minimum frequency by a ratio substantially greater than 3 to 1.

35. A variable frequency RFQ linear accelerator as recited in claim 17, wherein said frequency of oscillation may be varied over a range such that the maximum frequency exceeds the minimum frequency by a ratio substantially greater than 3 to 1.

36. A variable frequency RFQ linear accelerator as recited in claim 18, wherein said frequency of oscillation may be varied over a range such that the maximum frequency exceeds the minimum frequency by a ratio substantially greater than 3 to 1.

37. A variable frequency RFQ linear accelerator as recited in claim 1, wherein said frequency of oscillation may be varied over a range substantially from 10 megahertz to 100 megahertz.

38. A variable frequency RFQ linear accelerator as recited in claim 2, wherein said frequency of oscillation may be varied over a range substantially from 10 megahertz to 100 megahertz.

39. A variable frequency RFQ linear accelerator as recited in claim 3, wherein said frequency of oscillation may be varied over a range substantially from 10 megahertz to 100 megahertz.

40. A variable frequency RFQ linear accelerator as recited in claim 4, wherein said frequency of oscillation may be varied over a range substantially from 10 megahertz to 100 megahertz.

41. A varaible frequency RFQ linear accelerator as recited in claim 5, wherein said frequency of oscillation may be varied over a range substantially from 10 megahertz to 100 megahertz.

42. A varaible frequency RFQ linear accelerator as recited in claim 6, wherein said frequency of oscillation may be varied over a range substantailly from 10 megahertz to 100 megahertz.

43. A variable frequency RFQ linear accelerator as recited in claim 7, wherein said frequency of oscillation may be varied over a range substantially from 10 megahertz to 100 megahertz.

44. A variable frequency RFQ linear accelerator as recited in claim 8, wherein said frequency of oscillation may be varied over a range substantially from 10 megahertz to 100 megahertz.

45. A variable frequency RFQ linear accelerator as recited in claim 9, wherein said frequency of oscillation may be varied over a range substantially from 10 megahertz to 100 megahertz.

46. A variable frequency RFQ linear accelerator as recited in claim 10, wherein said frequency of oscillation may be varied over a range substantially from 10 megahertz to 100 megahertz.

47. A variable frequency RFQ linear accelerator as recited in claim 11, wherein said frequency of oscillation may be varied over a range substantially from 10 megahertz to 100 megahertz.

48. A variable frequency RFQ linear accelerator as recited in claim 12, wherein said frequency of oscillation may be varied over a range substantially from 10 megahertz to 100 megahertz.

49. A variable frequency RFQ linear accelerator as recited in claim 13, wherein said frequency of oscillation may be varied over a range substantially from 10 megahertz to 100 megahertz.

50. A variable frequency RFQ linear accelerator as recited in claim 14, wherein said frequency of oscillation may be varied over a range substantially from 10 megahertz to 100 megahertz.

51. A variable frequency RFQ linear accelerator as recited in claim 15, wherein said frequency of oscillation may be varied over a range substantially from 10 megahertz to 100 megahertz.

52. A variable frequency RFQ linear accelerator as recited in claim 16, wherein said frequency of oscillation may be varied over a range substantially from 10 megahertz to 100 megahertz.

53. A variable frequency RFQ linear accelerator as recited in claim 17, wherein said frequency of oscillation may be varied over a range substantially from 10 megahertz to 100 megahertz.

54. A variable frequency RFQ linear accelerator as recited in claim 18, wherein said frequency of oscillation may be varied over a range substantially from 10 megahertz to 100 megahertz.

* * * * *